US005429053A

United States Patent [19]

Walker

[11] Patent Number: 5,429,053

[45] Date of Patent: Jul. 4, 1995

[54] PYROTECHNIC FAN RACK

[76] Inventor: Ronald R. Walker, 4121 W. Rock Creek, Imperial, Mo. 63052

[21] Appl. No.: 173,615

[22] Filed: Dec. 22, 1993

[51] Int. Cl.[6] ..... F42B 4/26

[52] U.S. Cl. ..... 102/342; 102/345; 102/361

[58] Field of Search ..... 102/361, 342, 345

[56] References Cited

U.S. PATENT DOCUMENTS

| | | | |
|---|---|---|---|
| 956,546 | 5/1910 | Schulman | 11/11 |
| 3,227,084 | 1/1966 | Stokes et al. | 102/33 |
| 3,788,222 | 1/1974 | Evans | 102/37.4 |
| 4,222,306 | 9/1980 | Maury | 89/12 |
| 4,771,695 | 9/1988 | Simpson | 102/343 |

*Primary Examiner*—Peter A. Nelson

*Attorney, Agent, or Firm*—Polster, Lieder, Woodruff & Lucchesi

[57] ABSTRACT

A pyrotechnic fan rack for mounting a plurality of individual fireworks pieces in a fanned array. The rack has an elongated body with an arcuate top profile and a flat base. Mounting ears are formed on the base to secure the rack to a surface. A series of sockets are formed through the top wall of the body along the horizontal length of the body. Each socket is formed in the body with its axis in preselected fixed angle relative to the axis of adjacent sockets. Tubes containing fireworks pieces are mounted in the sockets and extend out of the holes with their discharge ends in a desired angular relationship to adjacent firework pieces. A fuse groove seating an ignitable instantaneous fuse is formed along a horizontal length of the body connecting each of the sockets.

10 Claims, 5 Drawing Sheets

PYROTECHNIC FAN RACK

BACKGROUND OF THE INVENTION

This invention relates generally to fireworks devices, and more particularly, to a fan rack for the mounting and plurality of individual fireworks pieces arranged in a fan array and a fireworks device formed thereby.

For those who present fireworks shows it is common to arrange individual pieces of fireworks in an array to produce an asthetically pleasing aerial display wherein multiple fireworks are launched or fired into the sky to form a pattern. The aerial displays are generally composed of a plurality of individual aerial shells, star comets, mines, sky rockets, or other fireworks. Thus, an aerial display may contain exploding stars, stars, or aerial bursts. The individual fireworks pieces are arranged to ignite simultaneously or so near to simultaneously as to give the illusion of simultaneous ignition and launching.

In general, individual fireworks pieces are supplied in cardboard tubes which contain a propellant and a pyrotechnic display. The propellant lifts the display into the sky, whereupon the display ignites and provides a pleasing aerial effect. A fuse or electrical detonator extends out of the tube for igniting the fireworks piece. An electric ignition system is generally used in commercial or professional applications to the pyrotechnic device. Upon ignition there is an explosion and the fireworks shoot into the sky to form an aerial or mine display.

Heretofore, to set up a display comprised of more than one fireworks piece, the pyrotechnician had to jerry-build an array out of separate fireworks pieces. This is done by setting up individual tubes, side-by-side, with the discharge ends of the tubes arranged at appropriate angles so that the displays shoot out of the tubes skyward and explode in a pattern. If the relative angular relationship of the discharge ends of the tubes is not right, the fireworks will appear in the sky too close together or too far apart resulting in an unsatisfactory aerial fireworks display.

Each time a display is set up the technician has to mount the individual tubes, in a side-by-side arrangement, on the ground or other surface. The technician then has to calculate the appropriate angle of each tube, relative to its adjacent tube, so that the fireworks discharged from the tubes appear properly separated in the sky. The tubes then must be secured to a platform or to the ground in the proper angular arrangement. This secured, side-by-side arrangement of a plurality of fireworks tubes is generally known in the industry as a "fan".

When setting up a fan, the technician has to secure each tube to the ground or a platform in its appropriate relative angle so that the tube does not lean, fall, or otherwise move out of its proper angular alignment. Movement out of the proper angular alignment would not only ruin the visual effect of the aerial display, but could create a danger if, for example, a tube tipped to a position whereby the exploding fireworks could strike spectators, buildings or other objects. Furthermore, the technician must coordinate the ignition of the fireworks fuses so that each tube is ignited simultaneously, or so nearly simultaneously, as to give the visual impression that all the tubes have fired at one time.

Creating a fan array of fireworks pieces is time consuming and labor intensive. Moreover, to create more spectacular fireworks displays, it is desirable to have multiple rows of fan arrays to form one fireworks display. However, the more pieces of fireworks that are arranged in fan arrays, the more problems there are in the arrangement of such pieces. Typically, it is difficult and time consuming to form multiple arrays of individual pieces while maintaining the proper angular alignment of the pieces. Furthermore, the technician must provide for simultaneous ignition of the arrays.

If the pyrotechnician desires to launch a bank composed of multiple arrays of individual pieces, the technician must set up the individual pieces assuring proper alignment in more than one direction. If, for example, the technician sets up a display or bank having four arrays of five rockets each, the technician first must determine the proper angular relationships among twenty separate fireworks pieces so that the fireworks pieces launch into a coordinated and pleasing aerial display. Next, the technician must secure twenty individual pieces to the ground in those relative positions. Finally, the technician must arrange for the individual pieces to be ignited so that the fireworks pieces fire simultaneously or near simultaneously.

It should be readily apparent to those skilled in the art that creating a display of fireworks using multiple pieces in multiple fan arrays can be labor intensive, time consuming and also requires more material such as detonators which are expensive. Furthermore, it can be difficult to get consistent results, display-to-display, since each display must be individually arranged and secured.

SUMMARY OF THE INVENTION

It is, therefore, a principal object of the present invention to provide a fireworks fan rack to hold a plurality of individual fireworks in a predetermined fan array.

It is another object of the invention is to provide a fireworks fan that allows for easy and consistent mounting of individual fireworks pieces in the proper angular relationships relative each other.

Yet another object of the present invention is to provide a fireworks fan rack that allows for the simultaneous or near simultaneous ignition of all the individual fireworks pieces mounted in the rack.

Still another object of the present invention is to provide a fireworks fan rack for the mounting of a plurality of individual fireworks pieces in a fan array that can be secured to the ground or other flat surface to hold the fireworks in the desired positions for use.

A further object of the present invention is to provide a fireworks fan rack that can be secured to adjacent fireworks fan racks to form a bank of such racks that will allow the firing of a plurality of individual fireworks pieces to form a coordinated aerial display.

Yet another object of the present invention is to provide a fireworks fan rack that can be loaded with individual fireworks pieces by the manufacturer.

A still further object of the invention is to provide a fireworks fan rack which is structurally strong, lightweight, economical to manufacture, easy and convenient to use, and well suited for its intended purposes.

In accordance with the invention, briefly stated, a fireworks fan rack for the mounting of a series of individual fireworks pieces in fanned array is provided having an elongated body with an arcuate upper section and a flat base for resting on a surface. The base has mounting ears formed thereon to secure the rack to the surface. A series of sockets are formed in the body along a horizontal length of the body. Each socket is formed with its axis at an angle relative to the axis of adjacent sockets so that each fireworks piece inserted in a socket extends out of the socket with its discharge end in a desired angular relationship to that of adjacent fireworks pieces. A fuse groove is formed along the body and connects each of the sockets. An instantaneous ignitable fuse is placed in the fuse groove and is operatively connected to each of the fireworks pieces. An igniter is operatively connected to the fuse. Ignition of the fuse in the fuse groove causes near simultaneous ignition of the fireworks pieces so that the fireworks are launched simultaneously, or near simultaneously, to form a desired aerial pattern. A plurality of the fireworks fan racks can be attached, side-to-side, to form a bank of such racks.

DESCRIPTION OF PREFERRED EMBODIMENT

Figure 1:
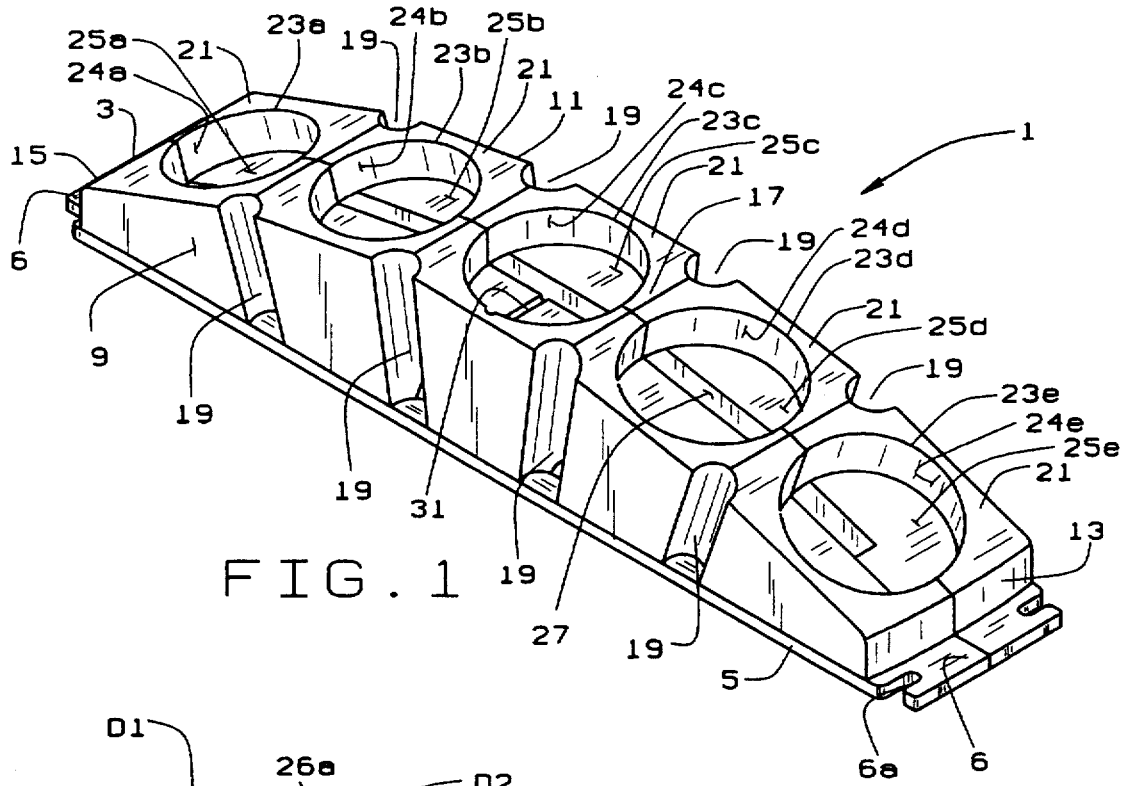
FIG. 1 is a perspective view of the preferred embodiment of the fireworks fan rack of the present invention.

A fan rack constructed in accordance with the present invention as indicated generally by reference numeral 1 in FIGS. 1–4. Fan rack 1 has a generally elongated body section 3. Body 3 has flat horizontal base segment 5. Base segment 5 has integral ears 6 formed on each end thereof. Each ear 6 has a screw cutout **6*a* formed therein for the insertion of a screw, nail or other appropriate mounting means. Body 3 has an arcuate profile. It should be noted, however, that body 3** does not have to have an arcuate profile to be within the scope of the invention as will be described below.

Body 3 is defined by opposed elongated sidewalls 9 and 11, opposed end walls 13 and 15 and a top wall 17. In the embodiment as illustrated in FIGS. 1–4, top wall 17 is arcuate. A series of semicircular indentations 19 are formed in side walls 19 and 11. Indentations 19 delineate individual body segments 21. A series of holes or sockets **23*a* to 23*e* are formed in the body segments through top wall 17, there being a separate socket 23 in each segment. Sockets 23*a*–23*e* extend into body 3. The axis of center socket 23*c* is perpendicular to horizontal bottom section 5. Adjacent sockets 23*a*, 23*b*, 23*d* and 23*e* extend into body 3 on a slant or angle, as will be explained below. Sockets 3*a* through 23*e* are defined by cylindrical walls 24*a* through 24*e* respectively and bottom surfaces 25*a*–25*e* which extend perpendicular to the cylindrical walls 24*a* through 24*c***.

Figure 2:
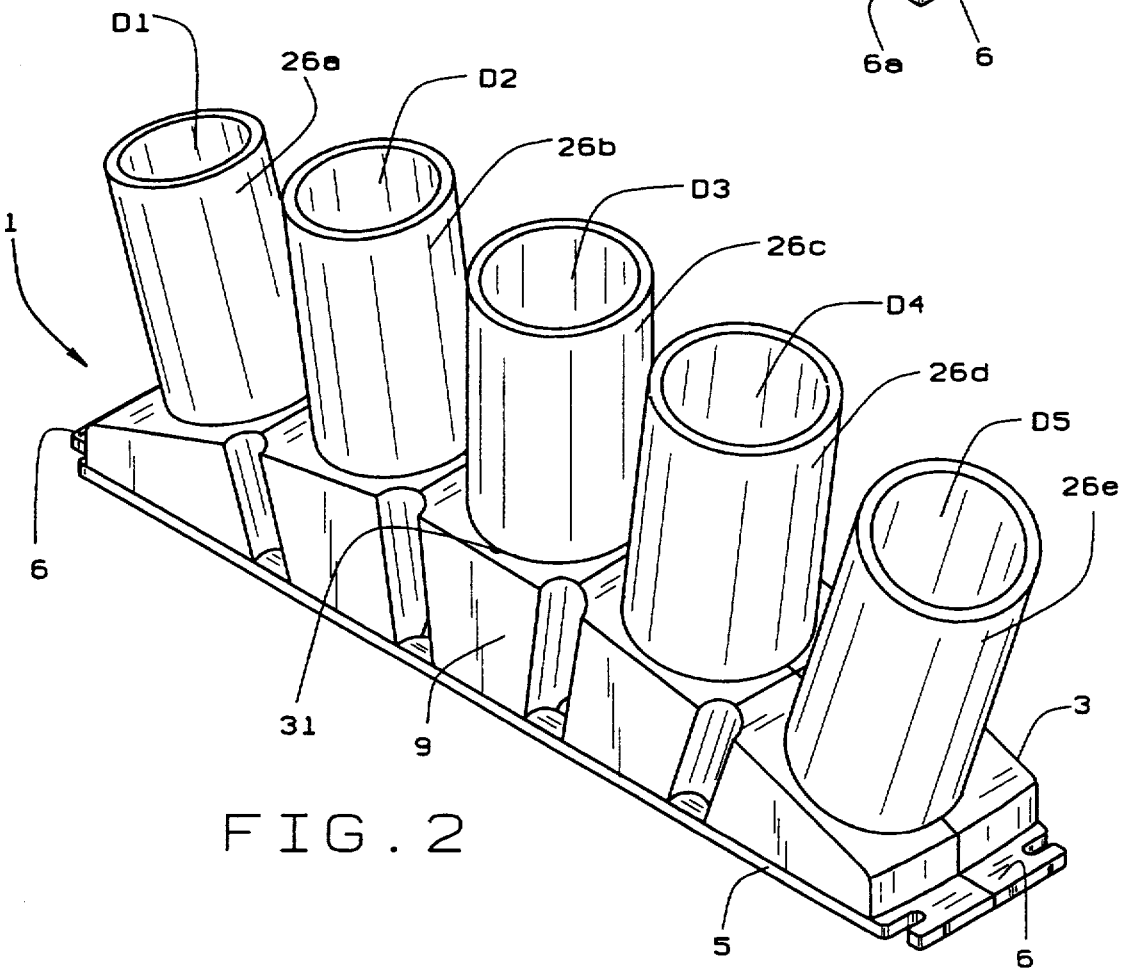
FIG. 2 is a perspective view of the fireworks fan rack of the present invention with a plurality of individual fireworks pieces mounted in the rack.
Figure 3:
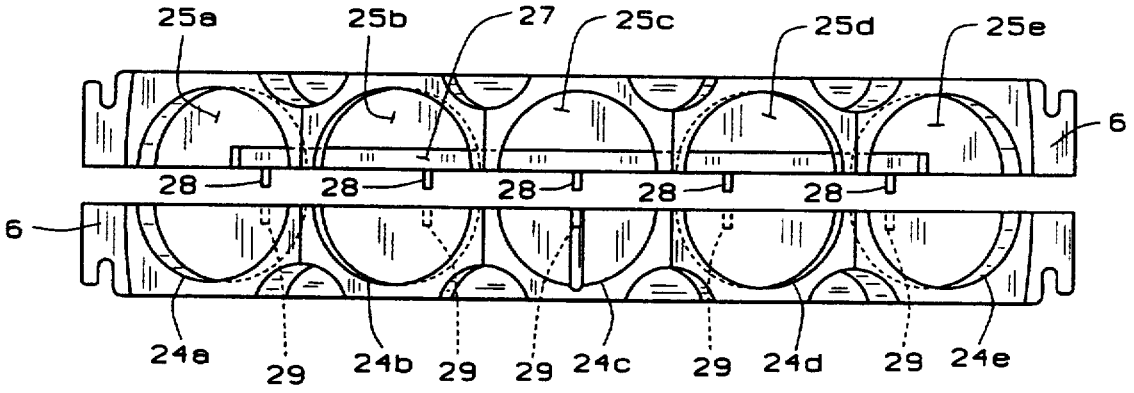
FIG. 3 is a top plan view of the fireworks fan rack of the present invention, in two halves, as extracted from a mold.

Sockets **23*a* through 23*e* are formed with an inside diameter appropriate to accommodate the insertion of a fireworks tube 25, as best illustrated in FIG. 2. For example the i.d. can be 0.750", 1.25" or 2.00". However, these dimensions are illustrative only. Preferably, the rack 1 is molded in two halves, as shown in FIG. 3, from a polymer which upon extraction from the mold is rigid. The two halves are separated by a parting face which extends longitudinally through the rack 1, bisecting its sockets 23*a*–23*e*. A fuse groove 27 exists as a rabbet along the parting face of one section, it being completed as a full groove when the two halves are joined. A suitable cement may be used to join the two halves, and to insure that the two halves are in registration when joined, one should have small alignment nibs 28 and the other small holes 29** to receive those nibs.

Fireworks tubes 26 should be glued in the sockets 23 or otherwise appropriately secured. The fireworks tubes **26*a*–26*e* can be mounted in the respective sockets by the manufacturer of the fireworks and shipped to the user. However, it is possible to provide the rack 1 with no fireworks tubes 26 in the sockets 23 to allow the user to mount the fireworks tubes 26 in the sockets 23. It should be apparent to one skilled in the art that the relative dimensions of rack 1, including the diameter of the respective sockets 23*a* through 23*e*, can vary according the size of fireworks tubes 26** to be mounted in the sockets.

Figure 4:
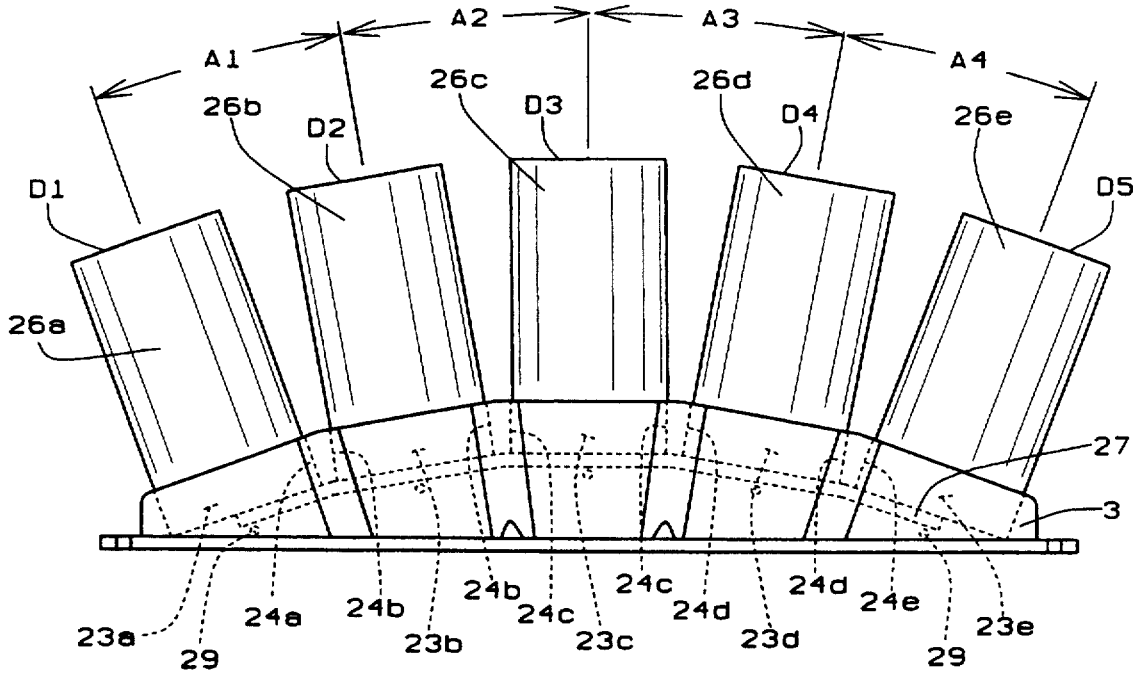
FIG. 4 is a side elevational view of the fireworks fan rack of the present invention with a plurality of individual fireworks pieces mounted therein.

As stated above, each socket **23*a* through 23*e* is formed in body 3 in a relative angular relationship to the adjacent socket as best illustrated in FIG. 4. In the embodiment illustrated in FIG. 4, sockets 23*a* to 23*e* are formed with predetermined angles A1–A4 between the axes of the sockets. In one preferred embodiment, angles A1–A4 are each 10°. As shown, tubes 26*a*–26*e* extend out of sockets 23*a*–23*e*, respectively. Discharge ends D1–D5 of tubes 26*a* to 26*e*, respectively, are thus positioned to discharge their contents or fireworks F at predetermined angles, relative to each other, to form an aerial fireworks display as illustrated in FIG. 5**.

Figure 5:
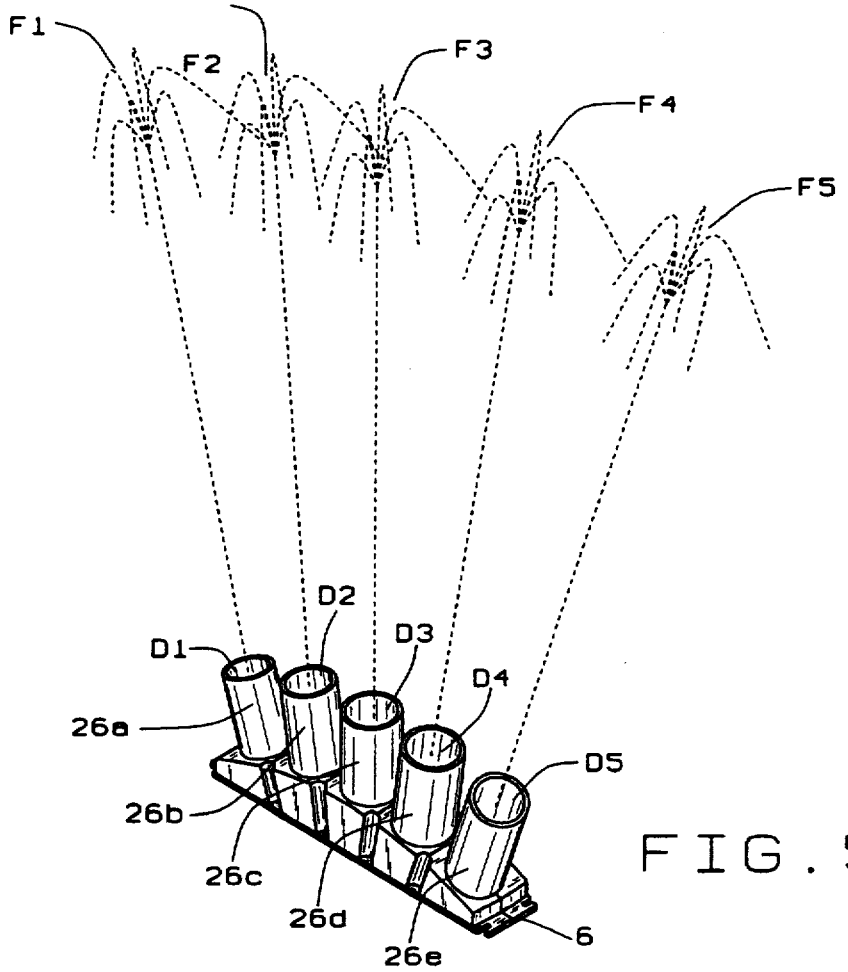
FIG. 5 is a perspective view of the fireworks fan rack of the present invention, after ignition, showing the relative the aerial display of fireworks launched from the individual fireworks pieces.
Figure 6:
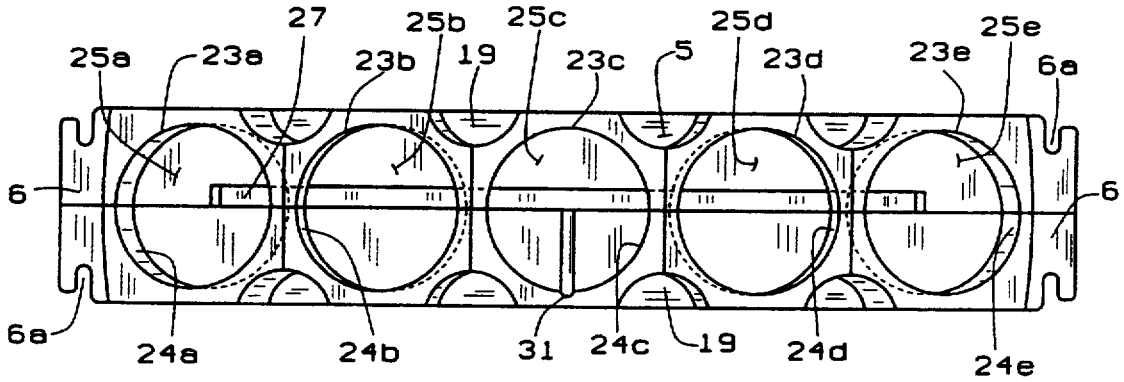
FIG. 6 is a top plan view of the fireworks fan rack of the present invention.
Figure 7:
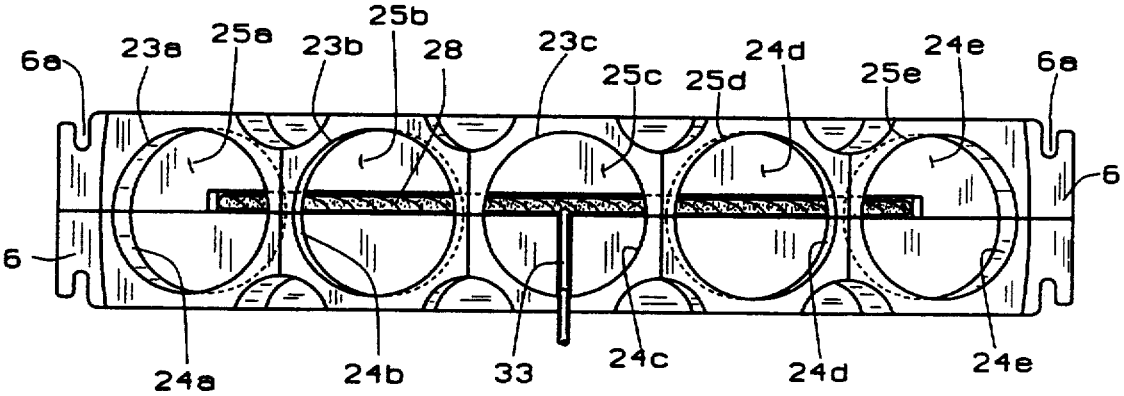
FIG. 7 is a top plan view of the fireworks fan rack of the present invention with an ignitable fuse in the fuse groove connected to an igniter wire.

The novel ignition feature of the present invention employed to assure the simultaneous or near simultaneous ignition and discharge of the fireworks pieces mounted in rack 1 is best illustrated in FIGS. 4–6. Fuse groove 27 is formed in body 3 as stated above. Fuse groove 27 runs generally horizontally the body 3 where it opens out of the bottom surfaces **25*a*–25*c* of the sockets 23*a*–23*e*. Fuse groove 27 extends between and communicates with holes 23*a*–23*e*. An ignitable fuse 30 is seated in and extends the length of groove 27. Fuse 30 is of a type instantly ignitable and well known to the art. It may consist of nothing more than a string covered with black powder. Fuse 30 is in contact with a fuse (not shown) or other ignition means exposed at the lower portion of the respective fireworks tubes 26*a*–26*e*. Leading to the fuse groove 27 within the center socket 23*c* is an ignition wire groove 31 which connects with fuse groove 27. It extends axially along the cylindrical wall 24c of the center socket 23c, from the arcuate top wall 17 to the bottom surface 25c of the socket 23c and thence along the bottom surface 25c to the fuse groove 27. The wire groove 31, which opens out of the cylindrical and bottom walls of the center hole 23c, contains an ignition wire 33, seated in groove 31, with its end in contact with ignitable fuse 30. A power source (not shown) supplies electricity through wire 33 to ignite fuse 30. Since fuse 30** is in contact with each fireworks piece, there is simultaneous or near simultaneous ignition of the individual fireworks pieces.

Figure 8:
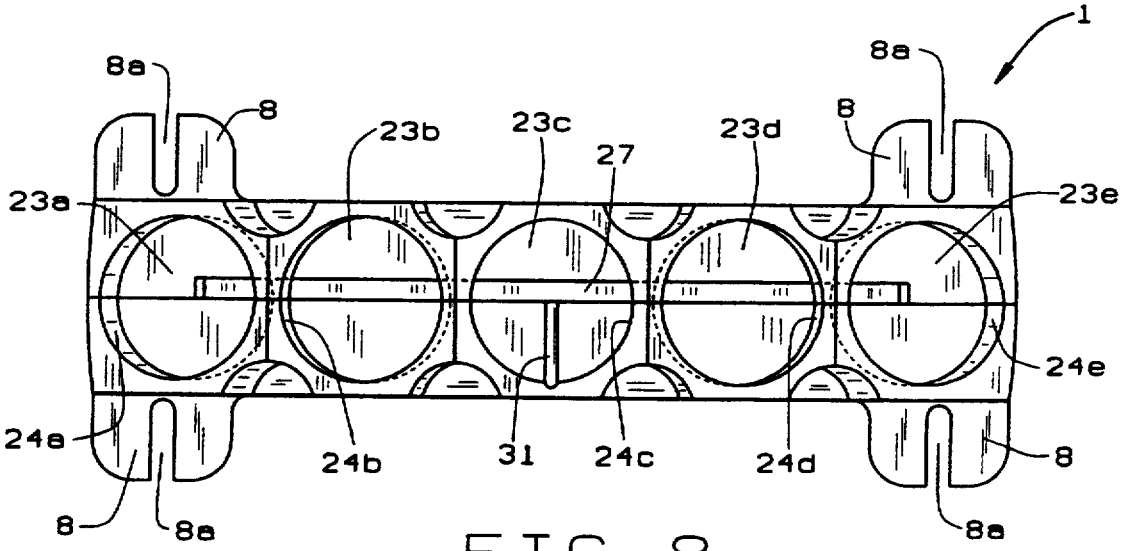
FIG. 8 is a top plan view of an alternative embodiment of a fireworks fan rack of the present invention.

FIG. 8 illustrates an alternative embodiment of fan rack 1. In this embodiment, mounting ears 8, having screw slots 8a formed therein, extend out from the sides of base 5. This structure adds lateral stability to rack 1.

Figure 9:
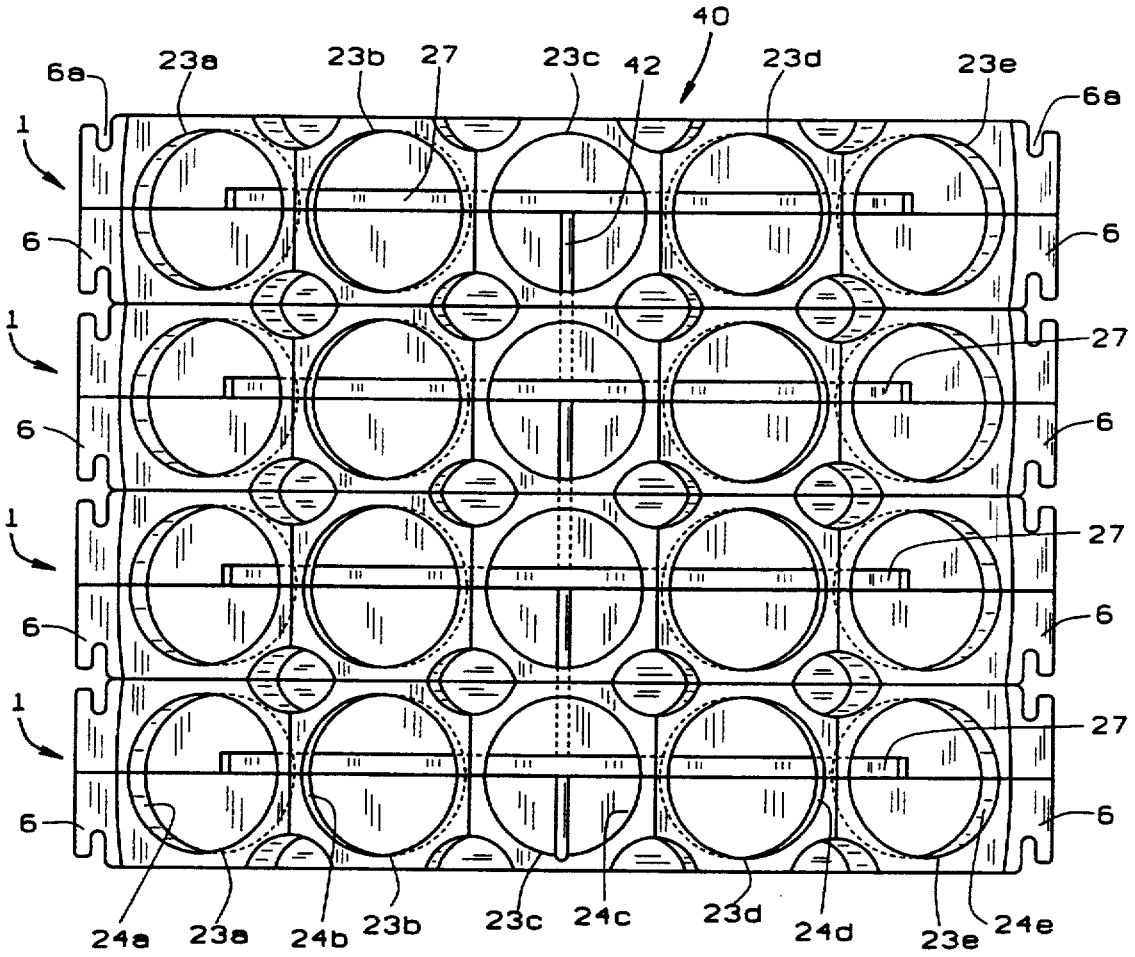
FIG. 9 is a top plan view of a bank of fireworks fan racks of the present invention.
Figure 10:
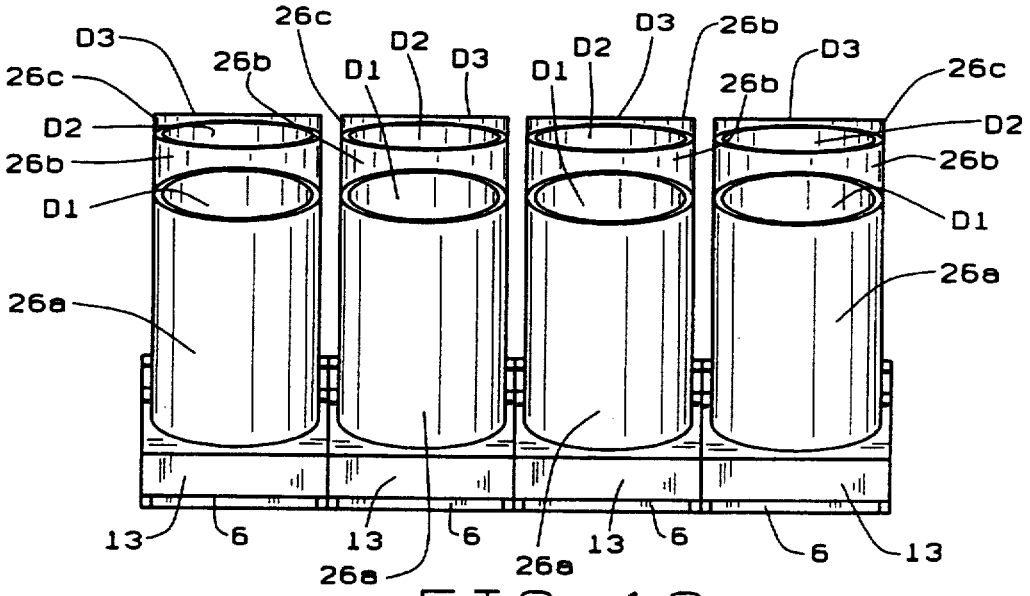
FIG. 10 is an end plan of the bank of fireworks fan racks of the present invention with a plurality of individual fireworks pieces mounted therein.

FIGS. 9 and 10 illustrate a bank 40 of individual fan racks 1. Each fan rack 1 is built in accordance with the invention as illustrated in FIG. 1–4. However, bank 40 contains a transverse ignition groove 42 which is connected to the individual fuse grooves 30 for the simultaneous ignition of fuses (not shown) seated in grooves 30. Mounting ears 6, extending from the ends of base section 5, allow side-by-side arrangement of a plurality of racks 1 in bank 40. FIG. 10 illustrates the relative relationship of a plurality of tubes 26a–26c, mounted in the bank 40.

Figure 11:
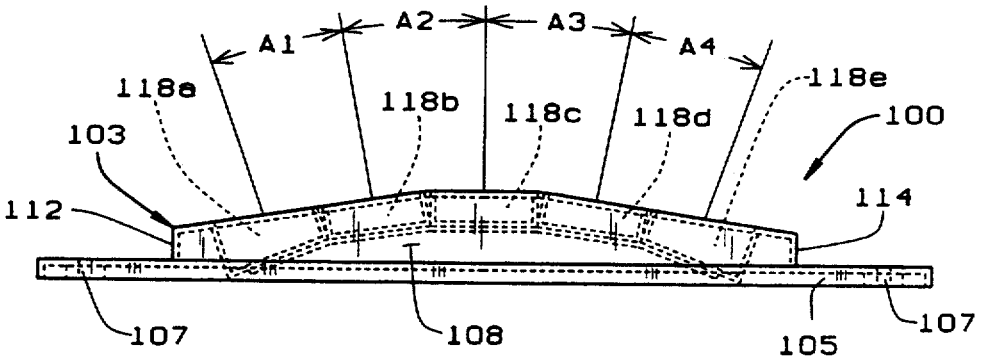
FIG. 11 is a side elevational view of another alternative embodiment of a fireworks fan rack of the present invention.
Figure 12:
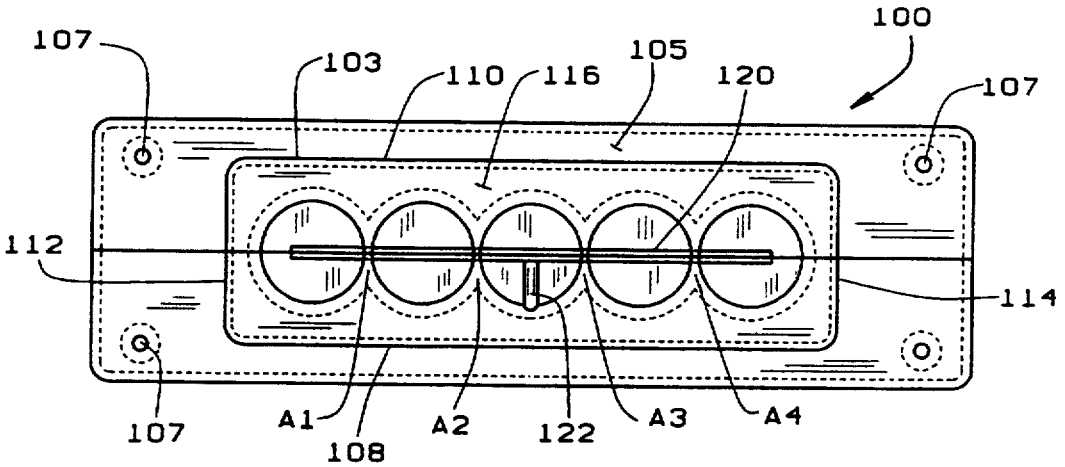
FIG. 12 is a top plan of the fireworks fan rack illustrated in FIG. 11.

FIGS. 11 and 12 illustrate another alternative embodiment of a rack, shown generally as reference numeral 100. Rack 100 is designed to mount small diameter, low residue fireworks to be used in smaller fireworks displays or in indoor displays. Rack 100 has an upper body 103 having a generally arcuate, horizontal profile and an integral flat base 105 extending around the periphery of body 103. Securing holes 107 are formed in the corners of base 105. Body 103 has a top wall 116. A series of holes or sockets 118a through 118e are formed through top wall 116 into body 103. As illustrated, center socket 118c is formed through body 3 with its axis perpendicular to base 105. Adjacent sockets 118a, 118b, 118d and 118e are formed in body 3 on an angle. Thus, angles A1 through A4 are formed between the axes of the sockets, as previously described relative to rack 1. Rack 100 is molded in two parts as is rack 1 previously described. A fuse groove 120 is formed in body 103 and is connected to sockets 118a–118e. Ignition wire channel 122 communicates with groove 120. An ignitable fuse (not shown) is seated in ignition groove 120. Grooves 120 and 122 function relative to each other as do grooves 27 and 31 of rack 1, as previously described.

It will be apparent to those skilled in the art that various modifications or changes can be made in the fan racks, as illustrated, without departing from the scope of the appended claims. For example, the horizontal profile of Body 3 of rack 1 could be a shape other than arcuate as long as the axes of sockets 23a to 23e are arranged at appropriate predetermined angles. Furthermore, the fuse groove 42 in bank 40 can be replaced with a transverse ignition groove to seat an ignition wire runs transverse to a plurality of ignitable fuses seated in the respective groove 27, for the near simultaneously ignition of all the ignitable fuses. These changes or modifications are intended to be illustrative of the various changes or modifications that can be made in the racks as described and illustrated and should not be construed in a limiting sense.

I claim:

1. A self-contained device for mounting fireworks pieces comprising:

an elongated body having a series of individual sockets formed along the length thereof for the receiving of a series of individual fireworks pieces; and a fuse channel formed along the length of said body to receive an ignition fuse, said fuse channel being in communication with each of said individual sockets;

said fuse channel and said individual sockets creating a continuous pyrotechnic chain so that an activation of the ignition fuse causes a simultaneous or near simultaneous ignition of each of the individual fireworks pieces.

2. The device of claim 1 in combination with fireworks pieces mounted in said sockets.

3. A rack for mounting a plurality of individual fireworks pieces for simultaneous or near simultaneous ignition in a fan array comprising:

a body having a horizontal base section and an elongated arcuate upper section;

a plurality of mounting holes formed in the arcuate upper section for the mounting of fireworks pieces therein;

a fuse channel formed in said body and operatively connected to each of said mounting holes; and a fuse means in said fuse channel in communication with said plurality of mounting holes so that activation of said fuse means causes simultaneous or near simultaneous ignition of fireworks pieces mounted in said mounting holes.

4. The rack of claim 3 wherein the axis of each said mounting hole is located at a predetermined angle relative to the axis of adjacent holes so as to position the associated fireworks at said predetermined angles.

5. The rack of claim 3 having mounting means formed on said horizontal base section to facilitate the attachment of the rack to a surface.

6. The rack of claim 3 wherein a plurality of said racks are connected together to form a bank of said racks.

7. A self-contained device for mounting a plurality of individual fireworks pieces in a fan array comprising:

an elongated body having an arcuate upper section and a horizontal lower surface, said arcuate upper section having a series of sockets formed therein for the insertion of a fireworks piece in each of said sockets;

a first channel formed along the length of said rack and operatively connected to each of said sockets so that a fuse means placed in said channel is in operative contact with said fireworks pieces in said sockets; and a second channel formed in said rack to accommodate the insertion of an ignition means, said second channel operatively connected with said first channel so that said ignition means has operative contact with said fuse means in said first channel;

activation of said ignition means in said second channel causing simultaneous or near simultaneous ignition of said fuse means and said fireworks pieces in said sockets.

8. The device of claim 7 wherein each said socket is formed with its axis at a predetermined angle relative to said horizontal surface so that a fireworks piece inserted in each said socket will discharge its contents at such angle relative to said horizontal surface.

9. The device of claim 8 further comprising a plurality of individual fireworks pieces, one of each said pieces being mounted in one of each said sockets.

10. In combination with a plurality of individual fireworks pieces, a device for mounting the individual fireworks pieces so as to provide simultaneous or near simultaneous ignition of said individual fireworks pieces to create pleasing aerial display, said device comprising:

a body section having a top surface and a horizontal bottom surface;

a plurality of holes formed in said body section through the top surface, each of said holes receiving an individual piece of fireworks, each said hole being formed at a predetermined angle relative to adjacent holes;

a fuse channel formed in said body for seating of an ignitable fuse, said fuse channel extending to and opening into each of said holes so that said fuse seated in said fuse channel is exposed to each said piece of fireworks; and an ignition means channel formed in said body and leading to said fuse channel so that an ignition means inserted into said ignition means channel has operative contact with said fuse seated in said fuse channel;

said ignition means, said fuse, and said individual pieces of fireworks forming a continuous pyrotechnic chain so that an activation of said ignition means causes the simultaneous or near simultaneous ignition of said individual pieces of fireworks.

* * * * *